US006081769A

United States Patent [19]

Curtis

[11] Patent Number: 6,081,769

[45] Date of Patent: Jun. 27, 2000

[54] METHOD AND APPARATUS FOR DETERMINING THE OVERALL LENGTH OF A TRAIN

[75] Inventor: Dwight D. Curtis, Cedar Rapids, Iowa

[73] Assignee: WABTEC Corporation, Wilmerding, Pa.

[21] Appl. No.: 09/028,013

[22] Filed: Feb. 23, 1998

[51] Int. Cl.[7] ..... B61L 29/00; G01S 1/00

[52] U.S. Cl. ..... 702/158; 702/159; 701/301; 701/213; 246/125; 246/122 R; 340/903

[58] Field of Search ..... 702/158, 159; 246/125, 126, 122 R, 473.1; 340/902, 903, 904; 701/19, 201, 205, 207, 213, 215, 301

[56] References Cited

U.S. PATENT DOCUMENTS 5,699,986 12/1997 Welk ..... 246/125

5,890,682 4/1999 Welk ..... 246/125

*Primary Examiner*—Kamini Shah

*Attorney, Agent, or Firm*—Whitham, Curtis & Whitham

[57] ABSTRACT

A method and apparatus for determining the length of a train utilizing received signal such as a reference signal from a global positioning system or the like is disclosed. A first receiver receives a signal, such as a reference signal from a global positioning system or the like, from which a first position on a train may be determined. Similarly, a second receiver receives a signal from which a second position on the train may be determined. A processor, operatively coupled to the first and second receivers, determines the length of the train based on the first and second positions.

23 Claims, 3 Drawing Sheets

METHOD AND APPARATUS FOR DETERMINING THE OVERALL LENGTH OF A TRAIN

BACKGROUND OF THE INVENTION

The present invention generally relates to train monitoring and control systems such as end-of-train (EOT) systems or the like, and more particularly to a method and apparatus for determining the overall length of a train.

Knowledge of a train's overall length is often required to ensure safe operation and handling of the train. For example, the length of a train is utilized to assess whether the train has cleared a point on the track such as, for example, a siding or a switch. To ensure that the point has been cleared, the crew of the train may move the train past the point a distance equal to the train's length plus a predetermined safety factor. Normally, this method assures that the train has safely cleared the point. However, if the determined train length is significantly in error, one or more cars of the train may extend past the point possibly resulting a collision with another train.

Presently, train length is either measured directly or estimated by moving the train past a fixed point at a known velocity. A measurement is started when the front of the train passes the point and ended when the end of the train passes that point. The length of the train may then be measured by determining the distance of the front of the train from the point or calculated based on the velocity of the train. However, this method of determining the train's length is subject to human error and may prove time consuming when performed each time cars are added or removed from the train.

Known to the art are end-of-train (EOT) systems which provide a variety of functions once performed by crew riding in the caboose of a train. Two types of EOT systems exist: one-way EOT systems and a two-way EOT systems. Both types of EOT systems provide crew riding in the cab of a locomotive with key end-of-train information such as, for example, brake pipe pressure at the rear of the train, end of train motion, EOT battery condition, and marker light status.

Typically, one-way EOT systems comprises a cab unit mounted in the cab of the lead locomotive of the train and an end-of-train (EOT) unit mounted to the last car of the train. The EOT unit includes a transmitter which transmits last car status information monitored by the unit to a receiver in the cab unit. The cab unit then displays this information to the crew. In two-way EOT systems, the receiver and transmitter of the one-way system are replaced with transceivers which both receive and transmit information between the cab unit and the EOT unit. Thus, in addition to providing end-of-train information to the crew, the two-way EOT system allows the crew to command the EOT unit to release brake line pressure at the rear of the train thereby permitting simultaneous application of brakes at the front and rear of the train. This feature greatly improves the train's emergency braking capability. Consequently, in 1992, Congress amended the Federal Railroad Safety Act to require railroads to install two-way EOT systems by Jan. 1, 1998 on trains traveling over 30 miles per hour or operating on heavy grades.

It is therefore desirable to improve the safety and efficiency of railroad operations by providing apparatus for determining the length of a train utilizing a received signal such as a reference signal from a global positioning system or the like, wherein this determination may be automatically updated as cars are added to or removed from the train. It is further desirable that the apparatus be capable of operation in conjunction with existing EOT systems.

SUMMARY OF THE INVENTION

Therefore, a principle object of the present invention is to provide a method and apparatus for determining the length of a train.

Another object of the present invention is to provide a method and apparatus capable of updating this determination as cars are added or removed from the train.

A further object of the present invention is to provide a method and apparatus for determining the length of a train utilizing received signal such as a reference signal from a global positioning system or the like.

Accordingly, the present invention provides a novel method and apparatus for determining the length of a train utilizing received signal such as a reference signal from a global positioning system or the like. A first receiver is positioned on a train at a first position, preferably the front of the train. The first receiver receives a signal, such as a reference signal from a global positioning system or the like, from which the first position may be determined. Similarly, a second receiver is positioned on the train at a second position, preferably the end of the train. The second receiver receives a signal from which the second position may be determined. A processor, operatively coupled to the first and second receivers, determines the length of the train based on the first and second positions.

It is to be understood that both the foregoing general description and the following detailed description are exemplary and explanatory only and are not restrictive of the invention claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DESCRIPTION OF THE PREFERRED EMBODIMENT

Reference will now be made in detail to the presently preferred embodiment of the invention, an example of which is illustrated in the accompanying drawings.

Figure 1:
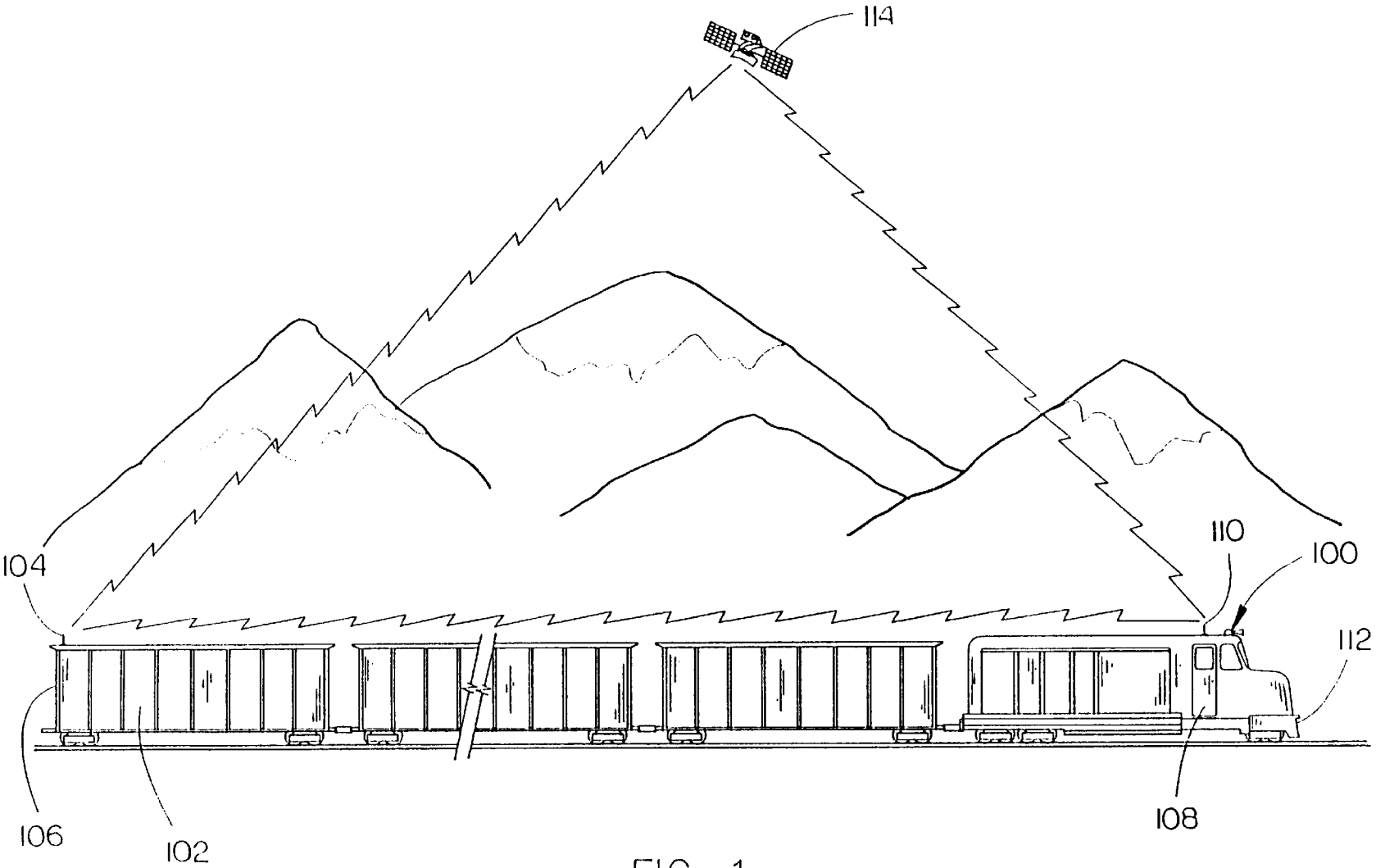
FIG. 1 depicts a train having a system for determining the length of the train according to an exemplary embodiment of the present invention.

Referring now to FIG. 1, a train having a system for determining the length of the train according to an exemplary embodiment of the present invention is shown. The train 100 preferably comprises one or more locomotives coupled to a plurality of cars which may be configured for transporting raw materials, freight, or passengers. An end car 102 of the train 100 may be equipped with a first receiver 104 which receives a signal such as a reference signal from a global positioning system and determines a first position such as, for example, a geo-referenced end-of-train position for the end of the train 106. Similarly, the front or lead locomotive 108 of the train 100 may be equipped with a second receiver 110 which receives a signal such as a reference signal from the global positioning system and determines a second position such as, for example, geo-referenced front-of-train position for the front of the train 112. A processor may be operatively coupled to the first and second receivers 104 & 110 (see FIG. 2). For example, the first receiver 104 may be coupled to a transmitter which communicates the first position to the processor via the second receiver 110 or a third receiver operatively coupled to the processor (see FIG. 2). The processor may then calculate the length of the train 100 based on the first and second positions by applying basic kinematic methods.

Preferably, both the first receiver 104 and the second receiver 110 are capable of receiving a geo-referencing signal from a global positioning system in order to accurately geo-reference the positions of front and end of the train. The global positioning system is preferably the Global Positioning System (GPS), a space-based radio-navigation system managed by the U.S. Air Force for the Government of the United States. The Government provides civilian access to the Global Positioning System which is called the Standard Positioning Service (SPS). The Standard Positioning Service is intentionally designed to provide a positioning capability which is less accurate than the positioning service provided to military operators, however various techniques have been developed to improve the accuracy of the civilian positioning service wherein position accuracy of one to five meters may be achieved.

The present system may be utilized in conjunction with the Global Positioning System (GPS) to accurately geo-reference the positions of the front and end of the train at a given time. The first and second receivers 104 & 110 may each receive a reference signal from a satellite 114 operating as part of the GPS satellite constellation. Typically the signals from at least three satellites are required to derive a coordinate position solution. Further reference signals which are not part of the government operated GPS system may also be used in order to compensate for the degraded civilian GPS signal (which may be transmitted as an FM carrier sublink by land based or space based locations or by an RS-232 data bus, for example). Such correcting signals may be provided by a third-party differential correction service provider. Other ways of correcting the degraded civilian signal may also be utilized which do not require an independent correcting signal to be transmitted. For example, signal processing techniques such as cross correlation of the military signal and the civilian signal may be utilized to improve the accuracy of the civilian signal.

Figure 2:
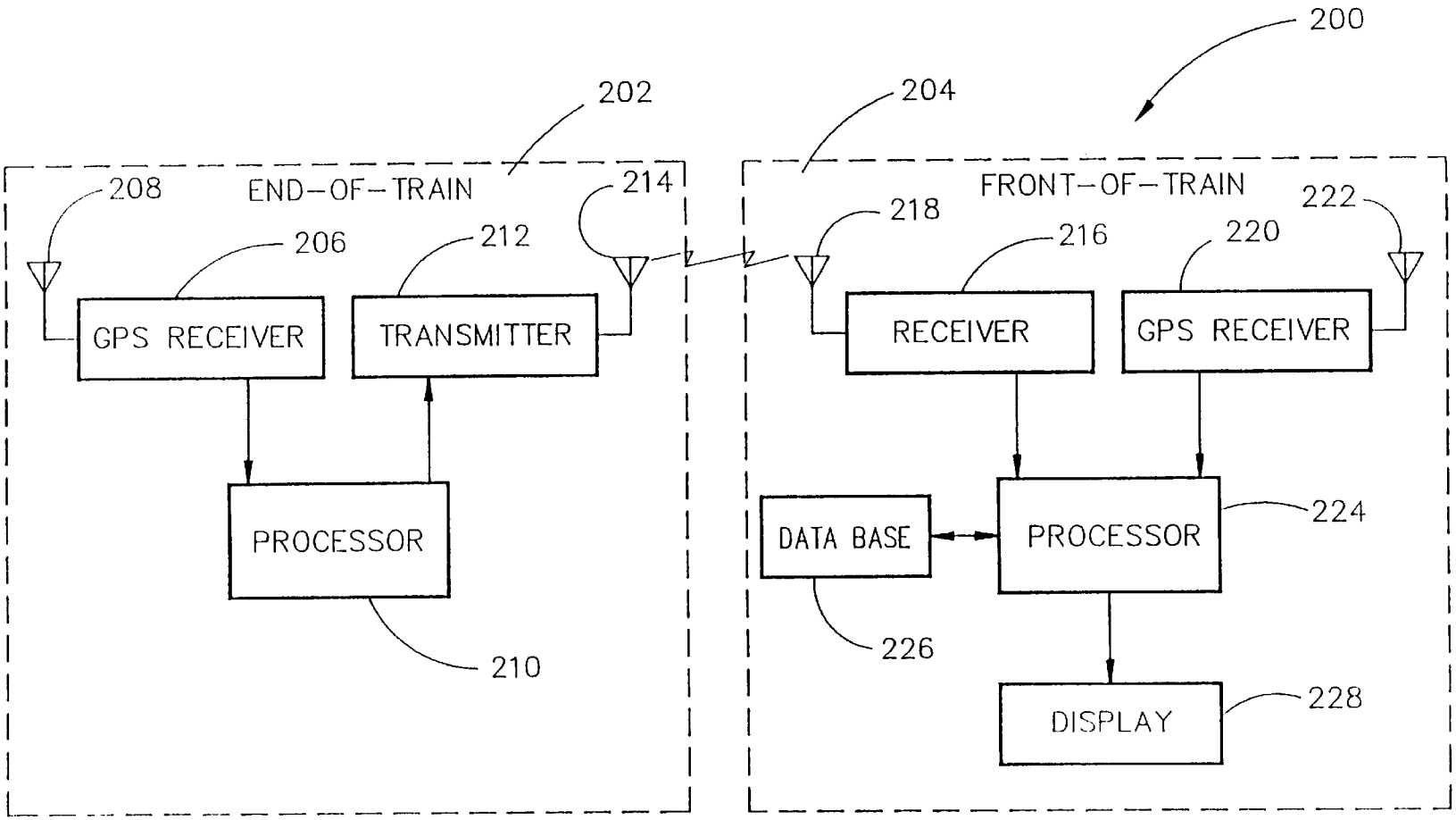
FIG. 2 is a block diagram depicting schematically exemplary apparatus of a system for determining the length of a train as shown in FIG. 1.

Referring now to FIG. 2, a block diagram depicting schematically exemplary apparatus of a system for determining the length of a train is shown. The system 200 preferably comprises an end-of-train unit 202 mounted to the last or end car of the train and a front-of-train unit 204 mounted in the cab of the first or lead locomotive.

The end-of-train unit 202 may include a GPS receiver 206 having an integral antenna 208 which receives a reference signal from the Global Positioning System (GPS). A processor 210 may periodically determine a geo-referenced end-of-train position for the end of the train utilizing the received reference signal from the GPS receiver 206. Preferably, the processor 210 also records the time when reference signal is received and the geo-referenced end-of-train position is determined. The processor 210 may be coupled to a transmitter 212 such as, for example, a radio frequency (RF) transmitter or transceiver and an antenna 214. The transmitter 212 preferably transmits the determined end-of-train position and recorded time to the front-of-train unit 204 where they are received by a receiver 216 such as an RF receiver or transceiver having a second antenna 218.

The front-of-train unit 204 may include a second GPS receiver 220 having an integral antenna 222 for receiving a reference signal from the Global Positioning System (GPS). Preferably, when the end-of-train position and recorded time are received by the receiver 216, a processor 224 in the front-of-train unit 204 causes the second GPS receiver 220 to receive a reference signal from the Global Positioning System (GPS). The processor 224 may then use the reference signal to determine a geo-referenced front-of-train position for the front of the train. The processor 210 may also record the time when the reference signal is received and the geo-referenced front-of-train position is determined. The processor 224 may then apply basic kinematic methods to determine the length of the train based on the determined front-of-train and end-of-train positions, recorded times when these positions were determined and speed of the train.

Those skilled in the art will recognize, however, that if the train is traveling on a curved section of track a simple kinematic calculation of the straight line distance between the end-of-train position and the front-of-train position will yield a train length which may be significantly shorter than the actual or true train length. To compensate for this problem, the front-of-train unit 204 may include a database 226 for storing reference information against which the determined end-of-train and front-of-train positions may be compared. This reference information preferably includes topographical information such as geo-referenced coordinates defining the path of the track on which the train is traveling. When calculating the length of the train, the processor 224 may interrogate this data base 226 and correlate the determined geo-referenced end-of-train and front-of train positions with the reference information stored in the database 226 to determine if the train is traveling along a straight or curved section of track. The processor 224 may then apply an adjustment factor for the curvature of the track on which the train is traveling to the calculation of the train's length. This adjustment factor may be stored in the database 226 and retrieved by the processor 224 based on the determined front-of-train and end-of-train positions.

The processor 224 may further compare the determined end-of-train position or front-of-train position with a known coordinate position of a point along the track so that an appropriate indication or warning may be provided when the train approaches or clears that point. For example, the crew riding in the locomotive may be provided with an indication that the end of the train has completely cleared a siding or switch, for example. A geo-referenced coordinate position of the siding or switch may be stored in the database 224. As the train approaches the siding or switch, the processor 224 may compare the determined front-of-train position with this coordinate position and provide an indication or warning to the crew that the train is approaching a siding or switch. As the train passes the siding or switch, the processor may periodically compare the determined end-of-train position with the coordinate position and provide an indication or warning to the crew that the end of the train has cleared the siding or switch. In this manner, safer, more precise handling of the train may be accomplished.

It may be impossible, due to the design of the end car or lead locomotive, to position the end-of-train unit or the front-of-train unit at the precise end or front of the train. Consequently, a small error in the train length calculation may be introduced. To compensate for this error, the processor 224 may apply an offset to the calculation of the train's length. This offset may be entered into the database 226, for example, when the end-of-train unit 202 and front-of-train unit 204 are installed.

A display 226 such as, for example, a liquid crystal display (LCD), cathode ray tube (CRT) display, or the like may display the length of the train to the crew of the lead locomotive. Preferably, the length of the train may be provided in alphanumeric or graphical formats. For example, the display 226 may provide an alpha-numeric indication of the trains length such as, for example "900 feet" or "300 meters." The length of the train may also be displayed graphically by representing the train on a map of the surrounding track. The display 226 may further provide warnings indicating that the train is approaching or has cleared a point such as a siding or switch and may include an audible warning device such as a loudspeaker, siren, horn, or the like.

Figure 3:
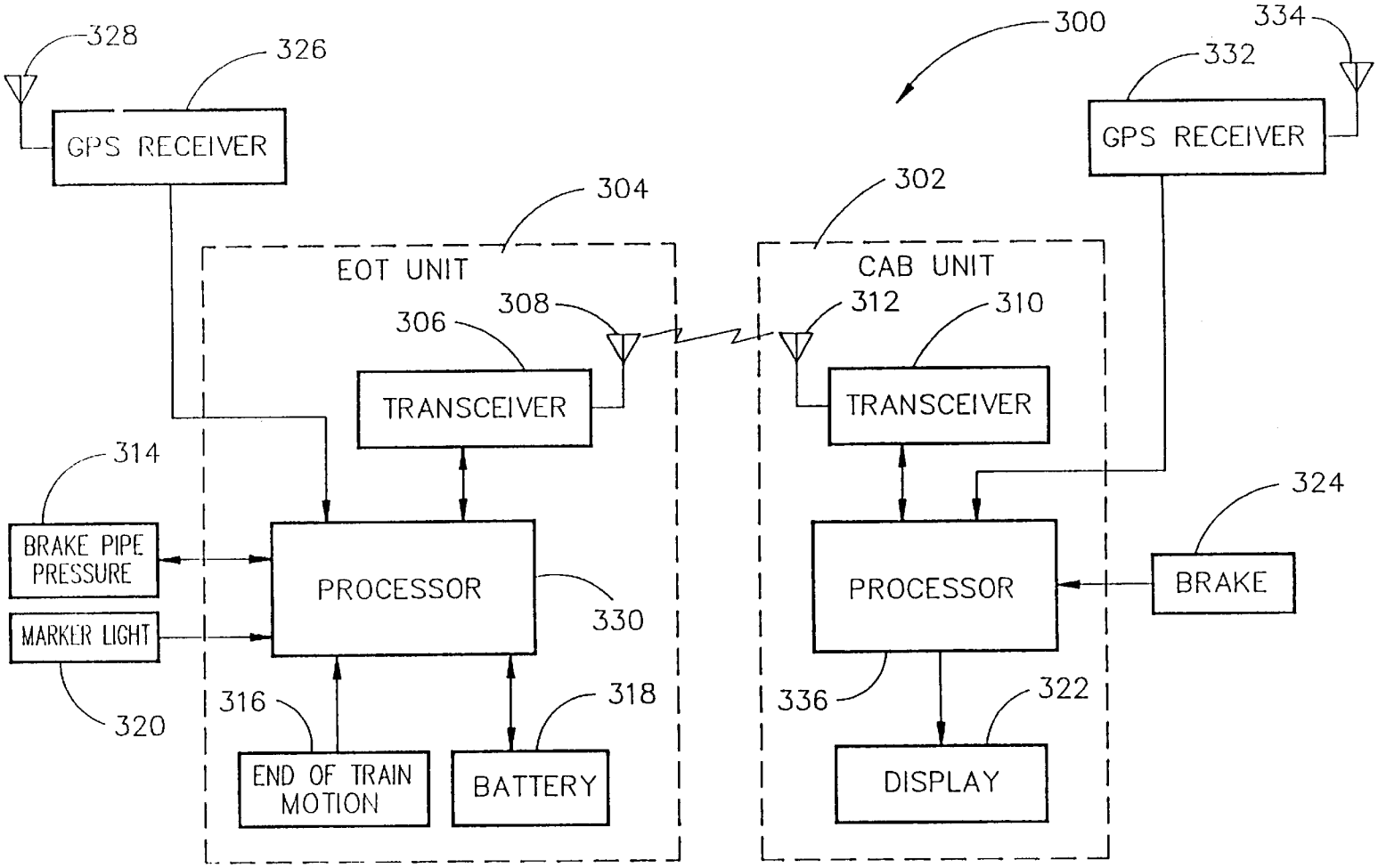
FIG. 3 is a block diagram illustrating a two-way EOT system modified according to an exemplary embodiment of the present invention with apparatus for determining the length of a train.

Turning now to FIG. 3, a block diagram is shown illustrating a two-way end-of-train (EOT) system modified to operate in conjunction with apparatus of the present invention to determine the length of a train. Although a two-way EOT system is described herein, those skilled in the art will recognize that other kinds of train monitoring and control systems such as, for example, one-way EOT systems and distributed power or braking systems may be similarly modified with apparatus according to the present invention.

The EOT system 300 preferably comprises a cab unit 302 mounted in the cab of the train's lead locomotive and an end-of-train (EOT) unit 304 mounted to the last car of the train. The EOT unit 304 may include a first transceiver 306 and antenna 308 for transmitting key last car status information monitored by the unit to a second transceiver 310 and antenna 312 in the cab unit 302. Preferably, the EOT system 300 provides crew riding in the cab of a locomotive with key end-of-train information such as, for example, brake pipe pressure 314 at the rear of the train, end of train motion 316, EOT battery condition 318, and marker light status 320. The cab unit 304 displays this information to the crew via a display 322. In addition to providing end-of-train information to the crew, the EOT system 300 allows the crew to command the EOT unit 304, via the brake system 324 and cab unit 302, to release brake pipe pressure 314 at the rear of the train thereby permitting simultaneous application of brakes at the front and rear of the train.

According to an exemplary embodiment of the present invention, the EOT system 300 may be modified to provide length of train information as an additional function. A first GPS receiver 326 and antenna 328 may be operatively coupled to the processor 330 of the EOT unit 304. The GPS receiver 326 receives a reference signal from the Global Positioning System (GPS). The processor 330 of the EOT unit 304 may periodically determine a geo-referenced end-of-train position of the of end of the train utilizing this reference signal. Preferably, the processor 330 also records the time when reference signal is received and the geo-referenced end-of-train position is determined. The determined end-of-train position and recorded time are preferably transmitted to the cab unit 302 via the EOT system's transceivers 306 & 310 and antennas 308 & 312.

Similarly, a second GPS receiver 332 and antenna 334 may be operatively coupled to the processor 336 of the cab unit 302. Preferably, when the end-of-train position and recorded time are received by the transceiver 310, the processor 336 causes the second GPS receiver 332 to receive a reference signal from the Global Positioning System (GPS). The processor 336 may then use the reference signal to determine a geo-referenced front-of-train position for the front of the train. The processor 336 may also record the time when the reference signal is received and the geo-referenced front-of-train position is determined. The processor 336 may then apply basic kinematic methods to determine the length of the train based on the determined front-of-train and end-of-train positions, recorded times when these positions were determined, and velocity of the train. The EOT system shown in FIG. 3 is not provided with a database for adjusting measurements taken on curved sections of track. Thus, the system as shown would only be capable of providing accurate train lengths along straight sections of track. However, the EOT system could be further modified to include such a database if desired.

It is believed that the method and apparatus for determining the length of a train of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A system for determining the length of a train comprising:

a first receiver disposed on the train at a first position, said first receiver for receiving a signal from which the first position may be determined;

a second receiver disposed on the train at a second position; said second receiver for receiving a signal from which the second position may be determined; and a processor operatively coupled to said first and second receivers, said processor for determining the length of the train based on the first and second positions and for applying an offset calculation in order to compensate for any errors in the determined length of the train.

2. The system of claim 1, wherein the signals from which the first and second positions may be determined are provided by a global positioning system.

3. The system of claim 1, further comprising a transmitter coupled to said first receiver for transmitting the first position to said processor.

4. The system of claim 3, wherein said transmitter comprises a radio frequency transceiver.

5. The system of claim 3, further comprising a third receiver coupled to said processor for receiving the first position transmitted by said transmitter.

6. The system of claim 5, wherein said third receiver comprises a radio frequency transceiver.

7. The system of claim 1, wherein said first receiver is mounted to an end car of said train.

8. The system of claim 1, wherein said second receiver is mounted to a front locomotive of said train.

9. The system of claim 1, further comprising a database operatively coupled to said processor, said database for storing reference information against which the first and second positions may be compared.

10. The system of claim 1, wherein said first receiver records a first time when said first position is determined and said second receiver records a second time when said second position is determined.

11. The system of claim 10, wherein said processor utilizes said first and second times to determine the length of the train.

12. The system of claim 1, wherein said first receiver is coupled to an end-of-train unit and said second receiver is coupled to a cab unit of an end-of-train system.

13. The system of claim 12, wherein said processor comprises a processor of said cab unit.

14. A system for determining the length of a train comprising:

means for determining the first position on the train;

means for determining a second position on the train; and means for determining the length of the train based upon the first and second positions;

means for comparing the first and second positions and recorded times of when the first and second position are determined with position reference information stored in a database in order to determine the length of the train on a curved section of track.

15. The system of claim 14, further comprising means for transmitting the first position and means for receiving the first position.

16. The system of claim 14, further comprising means for recording a the times when the first and second position are determined.

17. A method for determining a length of a train comprising the steps of:

determining a first position on the train utilizing a reference signal received from a global positioning system;

determining a second position on the train utilizing a reference signal received from a global positioning system;

calculating the length of the train based on the first and second positions and recorded times of when the first and second positions are determined; and recording the recorded times when said first and second positions are determined.

18. A method for determining a length of a train comprising the steps of:

determining a first position on the train utilizing a reference signal received from a global positioning system;

determining a second position on the train utilizing a reference signal received from a global positioning system;

calculating the length of the train based on the first and second positions and recorded times of when the first and second positions are determined; and comparing the first and second positions with position reference information stored in a database in order to determine the length of the train on a curved section of track.

19. A method of claim 18, further comprising applying an adjustment factor when the train is traveling on the curved section of the track.

20. A method of claim 18, further comprising applying an offset calculation in order to compensate for any errors in the determined length of the train.

21. A system for determining the length of a train comprising:

a first receiver disposed on the train at a first position, said first receiver for receiving a signal from which the first position may be determined;

a second receiver disposed on the train at a second position; said second receiver for receiving a signal from which the second position may be determined; and a processor operatively coupled to said first and second receivers, said processor for determining the length of the train based on the first and second positions; and a database operatively coupled to said processor, said database for storing reference information against which the first and second positions may be compared, wherein said reference information of said database includes topographical information and track path information used to determine whether the train is traveling on a straight track or a curved section of track.

22. A system for determining the length of a train comprising:

a first receiver disposed on the train at a first position, said first receiver for receiving a signal from which the first position may be determined;

a second receiver disposed on the train at a second position; said second receiver for receiving a signal from which the second position may be determined, and a processor operatively coupled to said first and second receivers, said processor for determining the length of the train based on the first and second positions; and a database operatively coupled to said processor, said database for storing reference information against which the first and second positions may be compared, wherein said processor interrogates said database and applies an adjustment factor when the train is traveling on a curved section of the track.

23. The system of claim 11, wherein said reference information stored in said database includes offset information used by said processor in the applying of the offset calculation.

* * * * *